US007706121B2

(12) United States Patent
Kato et al.

(10) Patent No.: US 7,706,121 B2
(45) Date of Patent: *Apr. 27, 2010

(54) ION GENERATOR

(75) Inventors: Shinji Kato, Mishima-gun (JP); Toshiyuki Miyamoto, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/177,214

(22) Filed: Jul. 22, 2008

(65) Prior Publication Data

US 2008/0278881 A1 Nov. 13, 2008

Related U.S. Application Data

(63) Continuation of application No. PCT/JP2007/074272, filed on Dec. 18, 2007.

(30) Foreign Application Priority Data

Jan. 31, 2007 (JP) ..... 2007-021846

(51) Int. Cl.
*H01T 23/00* (2006.01)

(52) U.S. Cl. ..... 361/231

(58) Field of Classification Search ..... 361/231
See application file for complete search history.

(56) References Cited

U.S. PATENT DOCUMENTS 7,564,671 B2 * 7/2009 Kato et al. ..... 361/231
2005/0036266 A1 2/2005 Kato et al.
2007/0091536 A1 4/2007 Kato et al.

FOREIGN PATENT DOCUMENTS

| | | | |
|---|---|---|---|
| JP | 06-033933 | U | 5/1994 |
| JP | 06-208898 | A | 7/1994 |
| JP | 08-171256 | A | 7/1996 |
| JP | 08-217412 | A | 8/1996 |
| JP | 11-310404 | A | 11/1999 |
| JP | 2003-017217 | A | 1/2003 |
| JP | 2005-116512 | A | 4/2005 |
| JP | 2005-126303 | A | 5/2005 |
| WO | 2007/091366 | A1 | 8/2007 |
| WO | 2007/091625 | A1 | 8/2007 |

OTHER PUBLICATIONS

Official Communication issued in International Patent Application No. PCT/JP2007/074272, mailed on Jan. 29, 2008.

* cited by examiner

*Primary Examiner*—Stephen W Jackson
(74) *Attorney, Agent, or Firm*—Keating & Bennett, LLP

(57) ABSTRACT

In an ion generator, a high-voltage electrode with a contact portion is disposed on a first main surface of an insulating substrate and is connected to a wire electrode, and a ground electrode covered with an insulating film is disposed on a second main surface of the insulating substrate. The ground electrode is electrically connected to a contact portion on the first main surface via a through hole. By disposing the high-voltage electrode and the ground electrode on different surfaces, the occurrence of an undesirable leakage current flowing from the high-voltage electrode to the ground electrode is prevented.

10 Claims, 5 Drawing Sheets

ION GENERATOR

BACKGROUND OF THE INVENTION

1. Field of the Invention

The present invention relates to ion generators, and, more particularly, to an ion generator used in an air cleaner or an air conditioner.

2. Description of the Related Art

In recent years, for environmental improvement, various ion generators have been provided. For example, an ion generator disclosed in Japanese Unexamined Patent Application Publication No. 2005-63827 is known. As illustrated in FIG. 8, in this ion generator, a ground electrode 142 covered with an insulating film 144 is disposed on a substrate 141, and a wire electrode 145 is disposed between two legs 142*a* and 142*b* of the ground electrode 142. The wire electrode 145 is connected to a high-voltage electrode 143 disposed on the substrate 141. When a high-tension current is supplied to the wire electrode 145, a leakage current flows from the wire electrode 145 to the ground electrode 142, so that ions are generated.

In this ion generator, however, the ground electrode 142 and the high-voltage electrode 143 are close to each other since they are disposed on the same surface. As a result, an undesirable leakage current flows from the high-voltage electrode 143 to the ground electrode 142. This reduces the number of ions generated.

SUMMARY OF THE INVENTION

To overcome the problems described above, preferred embodiments of the present invention provide an ion generator capable of stabilizing the number of ions generated by preventing the occurrence of an undesirable leakage current flowing from a high-voltage electrode to a ground electrode.

An ion generator according to a preferred embodiment of the present invention includes an insulating substrate, a ground electrode with a contact portion which is provided on the insulating substrate, an insulating film covering the ground electrode which is disposed on the insulating substrate, a high-voltage electrode including a contact portion which is disposed on the insulating substrate, and a wire electrode attached to the high-voltage electrode and arranged to face the ground electrode. The high-voltage electrode and the ground electrode are disposed on different surfaces of the insulating substrate.

In an ion generator according to this preferred embodiment of the present invention, the high-voltage electrode and the ground electrode are disposed on different surfaces of the insulating substrate. Accordingly, the distance between the high-voltage electrode and the ground electrode is increased, and the occurrence of an undesirable leakage current flowing from the high-voltage electrode to the ground electrode is prevented. As a result, the number of ions generated can be stabilized without reduction.

In an ion generator according to this preferred embodiment of the present invention, a through hole is preferably provided at the insulating substrate and one of the contact portions of the high-voltage electrode and the ground electrode preferably extends on the same surface as the other one of the contact portions of the high-voltage electrode and the ground electrode through the through hole. Since the contact portions of the high-voltage electrode and the ground electrode, which are disposed on different surfaces, can be provided on the same surface, each of the contact portions can be easily connected to a lead wire and the size of the ion generator can be reduced.

A plurality of wire electrodes may be provided. By providing a plurality of wire electrodes, ions can be generated in a plurality of directions over a wide area. Since the high-voltage electrode and the ground electrode are disposed on different surfaces even when a plurality of wire electrodes are provided, it is not necessary to provide a plurality of contact portions of each of the high-voltage electrode and the ground electrode. Furthermore, it is not necessary to increase the number of lead wires.

A plurality of wire electrodes may be individually disposed at opposite end portions of the insulating substrate. In this case, it is desirable that the ground electrode have a substantially X-shaped pattern. By configuring the ground electrode to have a substantially X-shaped pattern, the patterns of the ground electrode 42 can be collectively arranged in the approximate center of the insulating substrate, it is not necessary to provide a plurality of contact portions, and the distance between the ground electrode and the high-voltage electrode disposed on a surface different from the surface on which the ground electrode is disposed is increased. This prevents the occurrence of an undesirable leakage current.

A leading end portion of the ground electrode facing a leading end of the wire electrode may not be covered with the insulating film. In this case, the amount of leakage current flowing from the wire electrode to the ground electrode is increased, so that ions and a small amount of ozone are generated. The generation of ozone increases a deodorant effect and an antibacterial effect. In this case, the ground electrode is preferably a resistor. When the ground electrode is a resistor, the amount of ozone generated can be easily controlled by changing the resistance of the resistor.

A cutout may be provided at one side of the insulating substrate, the leading end of the wire electrode may be arranged in the cutout, and legs of the ground electrode may extend in a direction substantially parallel to the wire electrode sandwiched between the legs on opposite sides of the cutout on the insulating substrate. The wire electrode and the ground electrode may be two-dimensionally arranged, and the thickness of an ion generator can be reduced accordingly.

An ion generator preferably further includes a first terminal that is connected to the contact portion of the high-voltage electrode and includes a retaining portion arranged to be connected to a lead wire, a second terminal that is connected to the contact portion of the ground electrode and includes a retaining portion arranged to be connected to another lead wire, and a case arranged to accommodate the insulating substrate, the ground electrode, the wire electrode, the high-voltage electrode, the first terminal, and the second terminal. With this configuration, a small and low-cost ion generator can be obtained. Ribs are preferably provided at an opening of the case which faces the leading end of the wire electrode. The ribs prevent a user from touching the wire electrode with a user's finger. As a result, safety is improved.

In the ion generator according to this preferred embodiment of the present invention, the distance between the high-voltage electrode and the ground electrode is increased. As a result, the occurrence of an undesirable leakage current flowing from the high-voltage electrode to the ground electrode is prevented, and the number of ions generated is stabilized without reduction.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

An ion generator according to preferred embodiments of the present invention will be described below with reference to the accompanying drawings.

First Preferred Embodiment

Figure 1:
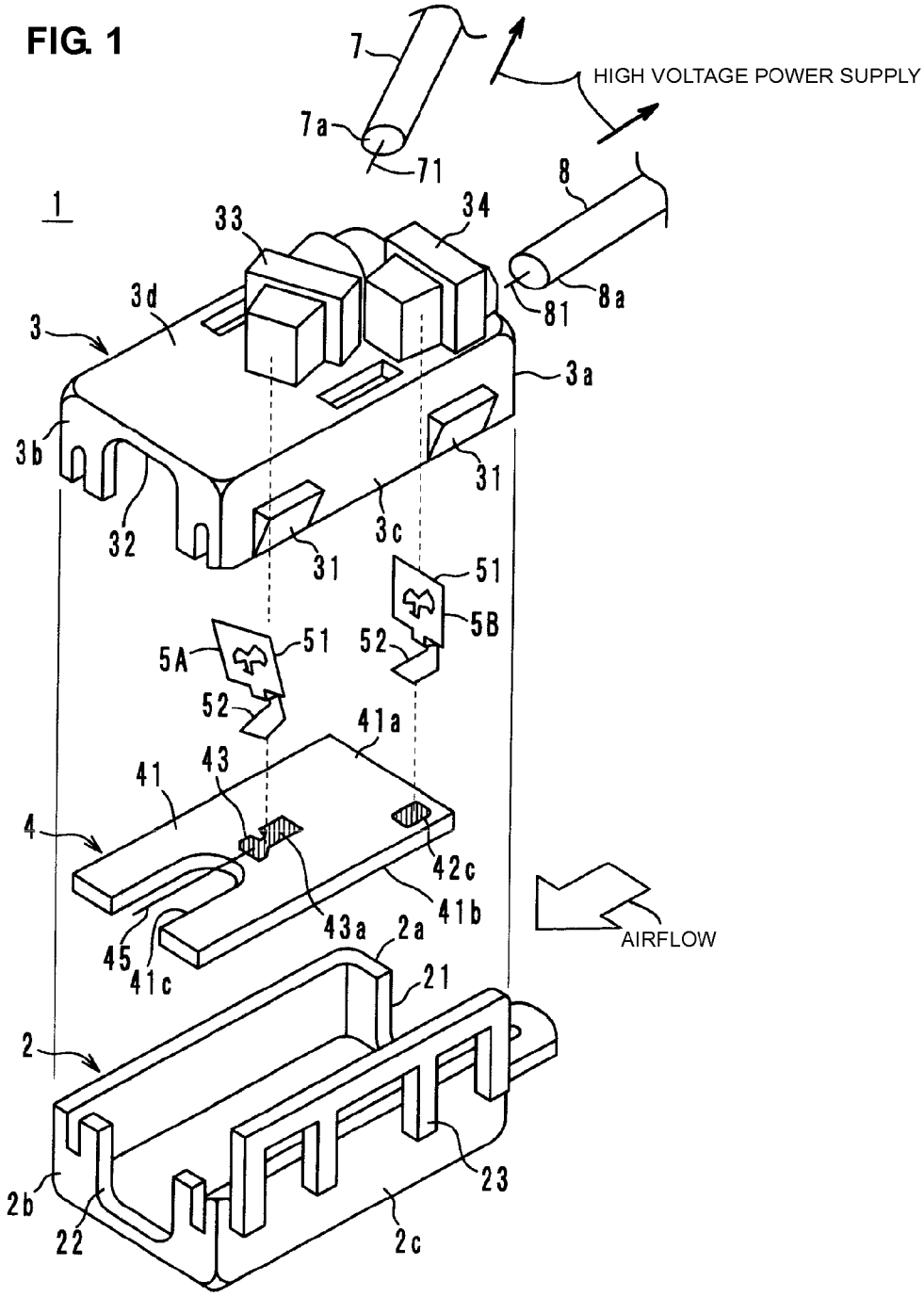
FIG. 1 is an exploded perspective view of an ion generator according to a first preferred embodiment of the present invention.
Figure 2:
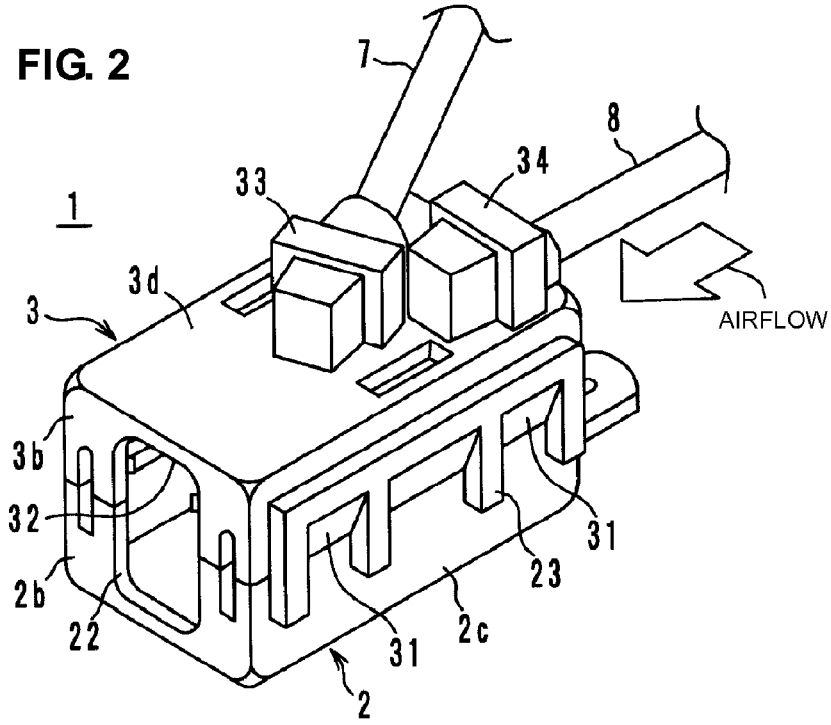
FIG. 2 is an external perspective view of the ion generator illustrated in FIG. 1.

FIG. 1 is an exploded perspective view of an ion generator 1 according to a first preferred embodiment of the present invention, and FIG. 2 is an external perspective view thereof. As illustrated in FIG. 1, the ion generator 1 preferably includes a lower resin case 2, an upper resin case 3, an ion-generating component 4, a first terminal 5A, a second terminal 5B, lead wires 7 and 8, and a high-voltage power supply (not illustrated).

The lower resin case 2 includes an air inlet 21 provided in a side wall 2*a* at one end, an air outlet 22 provided in a side wall 2*b* at the other end, and a retaining arm 23 on a front side wall 2*c*.

The upper resin case 3 includes an air inlet (not illustrated) provided in a side wall 3*a* at one end, an air outlet 32 provided in a side wall 3*b* at the other end and two claws 31 on a front side wall 3*c*. By fitting the claws 31 in the retaining arm 23 of the lower resin case 2, the upper resin case 3 and the lower resin case 2 are firmly joined to define an air-permeable resin case. The ion-generating component 4 and the terminals 5A and 5B are disposed in an accommodation portion defined inside the upper resin case 3 and the lower resin case 2.

Figure 3A:
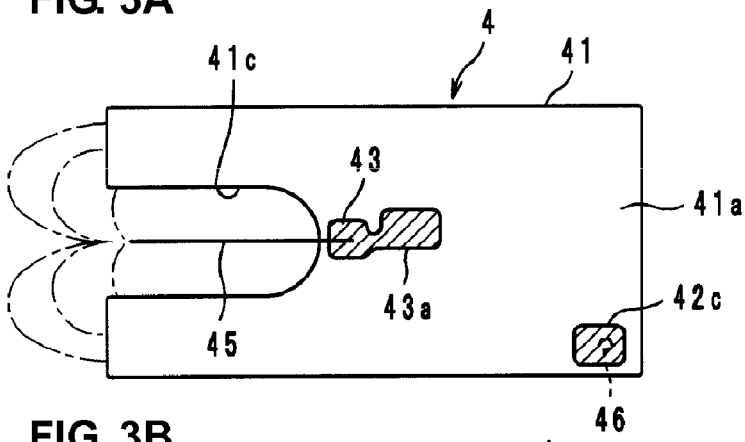
FIG. 3A is a diagram illustrating the surface of an insulating substrate used in the ion generator illustrated in FIG. 1.
Figure 3B:
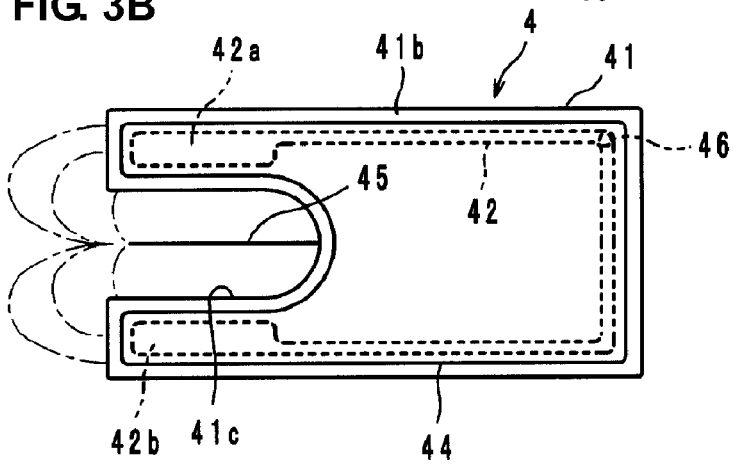
FIG. 3B is a diagram illustrating the undersurface of the insulating substrate.

In the ion-generating component 4, as illustrated in FIGS. 3A and 3B, on the surface (a first main surface 41*a*) of an insulating substrate 41, a high-voltage electrode 43 having a contact portion 43*a* and a contact portion 42*c* of a ground electrode 42, which will be described later, are formed of a conductive paste. A cutout 41*c* is formed by cutting out a large portion of one side of the insulating substrate 41. In the cutout 41*c*, a wire electrode 45 is disposed. The root of the wire electrode 45 is soldered to the high-voltage electrode 43. The wire electrode 45 is made of an ultrafine wire having a diameter of about 100 μm or less, for example, a piano wire, a stainless steel wire, or a titanium wire.

On the undersurface (a second main surface 41*b*) of the insulating substrate 41, the ground electrode 42 is formed of a conductive paste, and is covered with an insulating film 44. The ground electrode 42 includes a pair of legs 42*a* and 42*b* extending substantially parallel to the wire electrode 45 therebetween on opposite sides of the cutout 41*c* on the second main surface 41*b*. At one corner of the insulating substrate 41, a through hole 46 is provided. The ground electrode 42 on the second main surface 41*b* is electrically connected to the contact portion 42*c* on the first main surface 41*a* via the through hole 46.

As the material of the insulating film 44, for example, silicone or glass glaze is preferably used. The ground electrode 42 preferably has a resistance of approximately 50 MΩ, for example, and is made of, for example, ruthenium oxide paste or carbon paste. In particular, ruthenium oxide is the preferred material because it does not cause migration even when a high electric field is applied thereto.

Each of the first terminal 5A and the second terminal 5B is made of a metallic material, and includes a retaining portion 51 and a foot portion 52. The retaining portions 51 of the first terminal 5A and the second terminal 5B are fitted in holding portions 33 and 34 provided on an upper surface 3*d* of the upper resin case 3, respectively. The foot portion 52 of the first terminal 5A is connected to the contact portion 43*a* of the high-voltage electrode 43, and the foot portion 52 of the second terminal 5B is connected to the contact portion 42*c* of the ground electrode 42.

An end portion 7*a* of the high-voltage lead wire 7 is fitted in an opening (not illustrated) provided in the front surface of the holding portion 33 of the upper resin case 3, and a core wire 71 is engaged with and electrically connected to the retaining portion 51 of the first terminal 5*a*. Similarly, an end portion 8*a* of the ground lead wire 8 is fitted in an opening (not illustrated) provided in the front surface of the holding portion 34, and a core wire 81 is engaged with and electrically connected to the retaining portion 51 of the second terminal 5B.

The high-voltage lead wire 7 is connected to a high-voltage output terminal of the high-voltage power supply, and the ground lead wire 8 is connected to a ground terminal of the high-voltage power supply. While the high-voltage power supply supplies a negative direct-current voltage, it may supply an alternating-current voltage obtained by superimposing negative direct-current biases. The ion generator 1 is installed in, for example, an air cleaner or an air conditioner. That is, the high-voltage power supply is mounted in a power supply circuit portion of an air cleaner or other similar device, and the ion generator 1 is mounted in an air blow path, so that the air cleaner or other similar device blows air containing negative ions.

The ion generator 1 having the above-described configuration can generate negative ions at a voltage of about −1.3 kV to about −3.0 kV (typical). That is, when a negative voltage is applied to the wire electrode 45, an intense electric field is produced between the wire electrode 45 and the ground electrode 42. The air around the leading end of the wire electrode 45 is subjected to dielectric breakdown and is brought into a corona discharge state. At that time, molecules in the air are brought into a plasma state around the leading end of the wire electrode 45, and are separated into positive ions and negative ions. The positive ions in the air are absorbed by the wire electrode 45, and the negative ions remain.

When the wire electrode 45 has a thin leading end (has a small radius of curvature), the concentration of electrons is more easily achieved and an intense electric field is more easily produced than when it has a thick leading end. Therefore, the use of the wire electrode 45 having a diameter of about 100 μm or less enables negative ions to be generated even when a low voltage is applied. Since an applied voltage can be reduced, safety is improved. Furthermore, since the high-voltage electrode 43 and the ground electrode 42 are disposed on different surfaces (the first main surface 41*a* and the second main surface 41*b*) of the insulating substrate 41, the distance therebetween is increased. This prevents the flow of an undesirable leakage current from the high-voltage electrode 43 to the ground electrode 42. As a result, the number of ions generated can be stabilized without reduction.

Since the through hole 46 is provided at the insulating substrate 41 and the contact portion 42*c* of the ground electrode 42 extends onto the first main surface 41*a* via the through hole 46 along with the contact portion 43*a* of the high-voltage electrode 43, the contact portions 43*a* and 42*c* can be easily connected to the lead wires 7 and 8, respectively. This facilitates reducing the size of the ion generator 1.

In the ion generator 1, the insulating substrate 41 includes the cutout 41*c* at one side, the leading end of the wire electrode 45 is disposed in the cutout 41*c*, and the ground electrode 42 includes the legs 42*a* and 42*b* extending substantially parallel to the wire electrode 45 therebetween on opposite sides of the cutout 41*c* on the insulating substrate 41. Accordingly, the wire electrode 45 and the ground electrode 42 can be two-dimensionally arranged. This enables a reduction in the thickness of the ion generator 1.

Second Preferred Embodiment

Figure 4A:
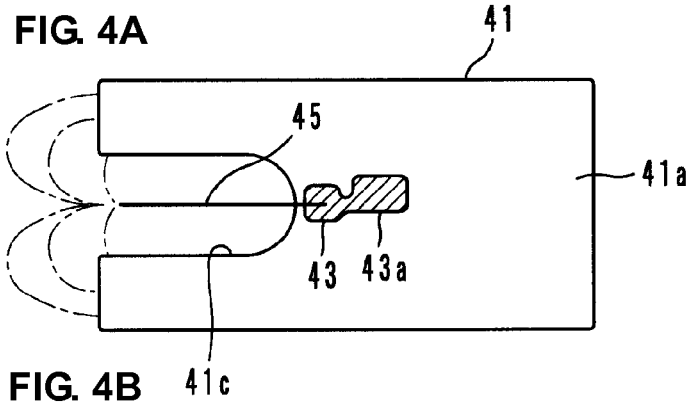
FIG. 4A is a diagram illustrating the surface of an insulating substrate used in an ion generator according to a second preferred embodiment.
Figure 4B:
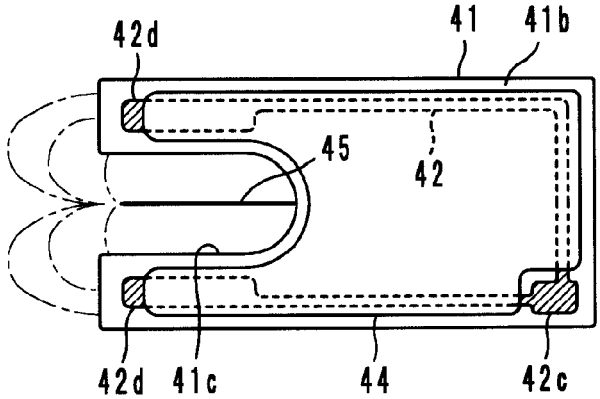
FIG. 4B is a diagram illustrating the undersurface of the insulating substrate.

FIGS. 4A and 4B illustrate the surface (the first main surface 41*a*) and the undersurface (the second main surface 41*b*) of the insulating substrate 41 used in an ion generator according to the second preferred embodiment of the present invention. The contact portion 42*c* of the ground electrode 42 is provided on the second main surface 41*b* and is connected to the extended foot portion 52 of the second terminal 5B without the through hole 46 described in the first preferred embodiment.

A leading end portion of the ground electrode 42 which is opposite the leading end of the wire electrode 45 is not covered with the insulating film 44. By exposing the leading end portion of the ground electrode 42, a leakage current flows between the ground electrode 42 and the wire electrode 45. This leakage current splits an oxygen molecule $O_2$ in the air into oxygen atoms O. Each of the oxygen atoms O reacts with an oxygen molecule $O_2$ in the air to form ozone $O_3$ ($O_2 + O \rightarrow O_3$). As a result, an extremely small amount of ozone is generated. The amount of ozone generated can be controlled by changing the area or position of an exposed portion 42*d*. Furthermore, the amount of ozone generated can be controlled by changing the resistance of the ground electrode 42 which functions as a resistor.

In the second preferred embodiment, the distance between the high-voltage electrode 43 and the ground electrode 42 can be increased since they are formed on different surfaces of the insulating substrate 41. This prevents the flow of an undesirable leakage current from the high-voltage electrode 43 to the ground electrode 42. As a result, the number of ions generated and the amount of ozone generated can be stabilized without reduction.

Except for the above-described points, the configuration and the operational effect according to the second preferred embodiment are substantially the same as those according to the first preferred embodiment.

Third Preferred Embodiment

Figure 5A:
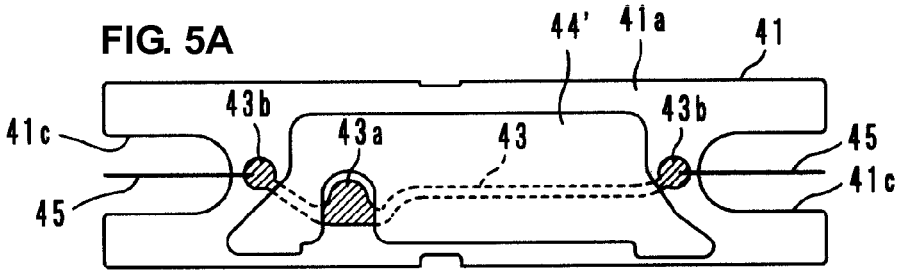
FIG. 5A is a diagram illustrating the surface of an insulating substrate used in an ion generator according to a third preferred embodiment.
Figure 5B:
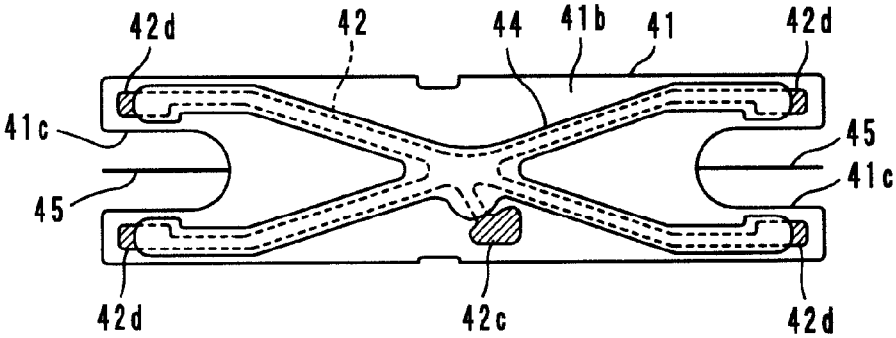
FIG. 5B is a diagram illustrating the undersurface of the insulating substrate.

FIGS. 5A and 5B illustrate the surface (the first main surface 41*a*) and the undersurface (the second main surface 41*b*) of the insulating substrate 41 used in an ion generator according to the third preferred embodiment of the present invention. In the third preferred embodiment, the wire electrode 45 is disposed at both end portions of the insulating substrate 41.

More specifically, the high-voltage electrode 43 provided on the first main surface 41*a* of the insulating substrate 41 is provided with a connection portion 43*b* to which the roots of the two wire electrodes 45 are soldered, and is covered with an insulating film 44' except for the connection portion 43*b* and the contact portion 43*a*. On the second main surface 41*b*, the ground electrode 42 having an X-shaped pattern is provided. In a central portion of the X-shaped pattern, the contact portion 42*c* is provided. The ground electrode 42 is covered with the insulating film 44 except for a leading end portion (the exposed portion 42*d*) facing the leading end of each of the wire electrodes 45 and the contact portion 42*c*.

The foot portion 52 of the first terminal 5A is connected to the contact portion 43*a* of the high-voltage electrode 43, and the extended foot portion 52 of the second terminal 5B is connected to the contact portion 42*c* of the ground electrode 42.

Except for the above-described points, the configuration and the operational effect according to the third preferred embodiment are substantially the same as those according to the first preferred embodiment.

In particular, by disposing the two wire electrodes 45, ions and ozone can be generated in both directions over a wide area. If the high-voltage electrode 43 and the ground electrode 42 are disposed on the same surface, the shape of the high-voltage electrode 43 is limited due to the existence of the ground electrode 42. In this case, two contact portions of the high-voltage electrode 43 are provided, and the two lead wires 7 are therefore required. However, since the high-voltage electrode 43 and the ground electrode 42 are disposed on different surfaces, the shape of the high-voltage electrode 43 on the first main surface 41*a* can be freely changed, so that it is not necessary to provide a plurality of contact portions 43*a* and a plurality of lead wires 7. Similarly, it is not necessary to provide a plurality of contact portions 42*c* of the ground electrode 42 and a plurality of lead wires 8.

Furthermore, since the pattern of the ground electrode 42 is X-shaped, the patterns of the ground electrode 42 can be collectively arranged in the central portion of the second main surface 41*b*. As a result, it is not necessary to provide a plurality of contact portions 42*c*, the distance between the ground electrode 42 and the high-voltage electrode 43 can be increased, and the occurrence of an undesirable leakage current can be further prevented. Consequently, the number of ions generated and the amount of ozone generated can be stabilized without reduction. As described previously in the second preferred embodiment, by exposing the leading end portion of the ground electrode 42, the amount of ozone generated can be increased.

Fourth Preferred Embodiment

Figure 6A:
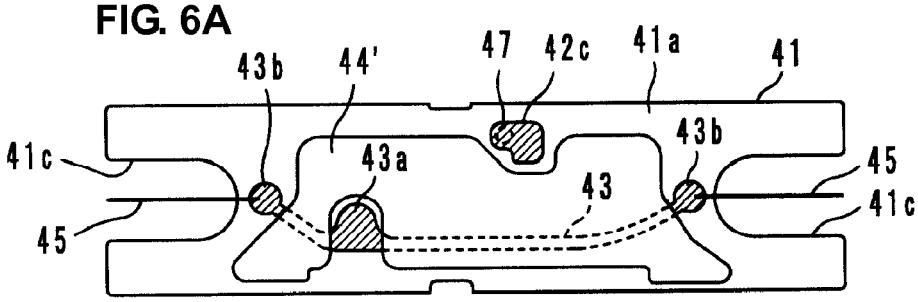
FIG. 6A is a diagram illustrating the surface of an insulating substrate used in an ion generator according to a fourth preferred embodiment.
Figure 6B:
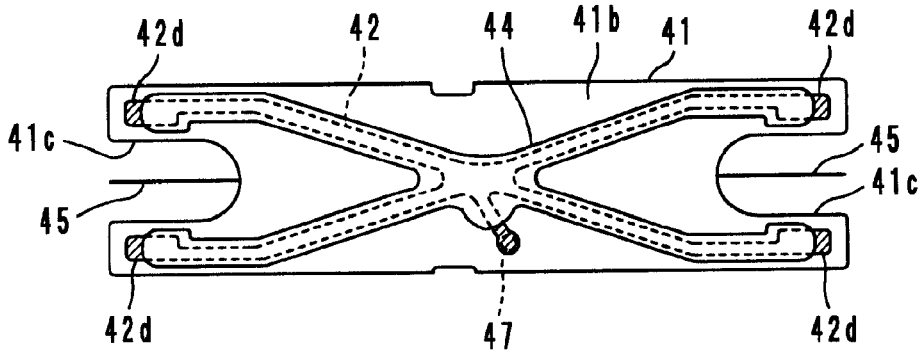
FIG. 6B is a diagram illustrating the undersurface of the insulating substrate.

FIGS. 6A and 6B illustrate the surface (the first main surface 41*a*) and the undersurface (the second main surface 41*b*) of the insulating substrate 41 used in an ion generator according to the fourth preferred embodiment of the present invention. In the fourth preferred embodiment, similar to the third preferred embodiment, the wire electrode 45 is disposed at both end portions of the insulating substrate 41. Furthermore, the ground electrode 42 provided on the second main surface 41*b* is electrically connected to the contact portion 42*c* provided on the first main surface 41*a* via a through hole 47 provided at the insulating substrate 41.

In the fourth preferred embodiment, since the contact portion 42*c* of the ground electrode 42 is provided on the first main surface 41*a* on which the high-voltage electrode 43 is disposed, the high-voltage electrode 43 is disposed on the side of one end portion of the insulating substrate 41 apart from the contact portion 42*c* of the ground electrode 42 so as to increases the distance between the high-voltage electrode 43 and the contact portion 42*c* of the ground electrode 42. As a result, the occurrence of an undesirable current is prevented. By disposing the ground electrode 42 on the side of one end portion of the insulating substrate 41 opposite the other end portion at which the high-voltage electrode 43 is disposed so as to further increase the distance between the high-voltage electrode 43 and the ground electrode 42, the occurrence of an undesirable leakage current is further prevented.

Except for the above-described points, the configuration and the operational effect according to the fourth preferred embodiment are substantially the same as those according to the first and third preferred embodiments.

Fifth Preferred Embodiment

Figure 7:
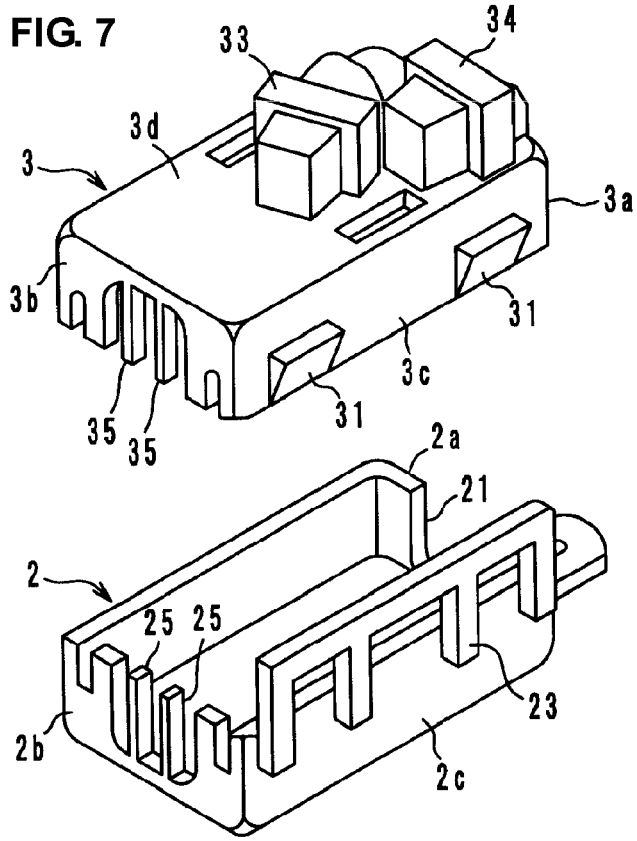
FIG. 7 is an exploded perspective view of a case for an ion generator according to a fifth preferred embodiment.
Figure 8:
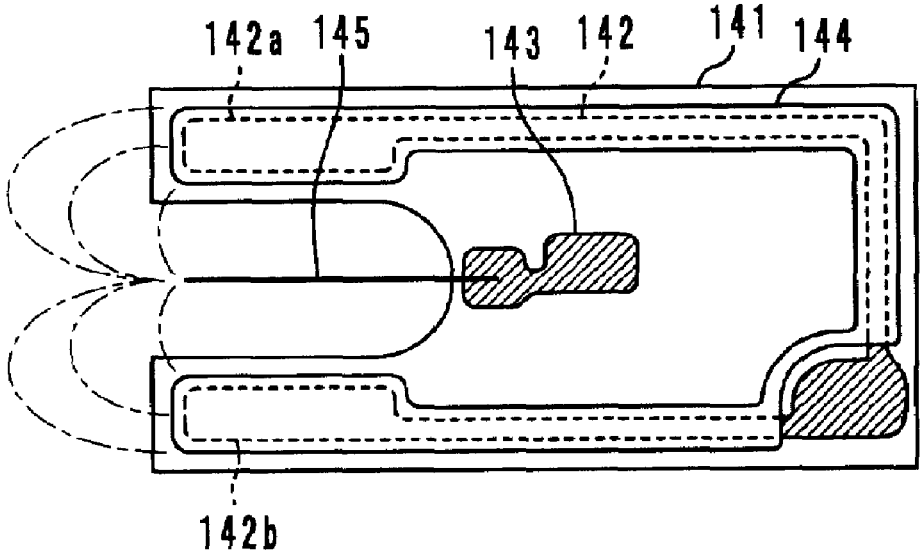
FIG. 8 Prior Art
FIG. 8 is a diagram illustrating the surface of an insulating substrate used in an ion generator in the related art.

FIG. 7 illustrates the cases 2 and 3 of an ion generator according to the fifth preferred embodiment of the present invention. A configuration according to the fifth preferred embodiment is substantially the same as that according to the first preferred embodiment. That is, ribs 25 and ribs 35 are provided at the openings (the air outlets 22 and 23 facing the leading end of the wire electrode 45, see, FIG. 1) of the cases 2 and 3, respectively. The ribs 25 and 35 prevent a user from touching the wire electrode 45 with a user's finger, so that safety is improved.

An ion generator according to the present invention is not limited to an ion generator according to any one of the above-described preferred embodiments. Various changes can be made to an ion generator according to the present invention without departing from the spirit and scope of the present invention.

For example, the exposed portion 42*d* of the ground electrode 42 may have any suitable shape, and may be disposed at a plurality of locations.

The present invention can be applied not only to the generation of negative ions but also to the generation of positive ions. In this case, a high-voltage power supply for generating a positive voltage is used, and a positive voltage is applied to a high-voltage electrode.

As described previously, the present invention is useful for an ion generator, and, in particular, has an advantage in its suitability for stabilizing the number of ions generated.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An ion generator comprising:

an insulating substrate;

a ground electrode disposed on the insulating substrate and including a contact portion;

an insulating film arranged to cover the ground electrode disposed on the insulating substrate;

a high-voltage electrode disposed on the insulating substrate and including a contact portion; and a wire electrode attached to the high-voltage electrode and arranged to face the ground electrode; wherein the high-voltage electrode and the ground electrode are disposed on different surfaces of the insulating substrate.

2. The ion generator according to claim 1, wherein a through hole is provided in the insulating substrate, and one of the contact portions of the high-voltage electrode and the ground electrode is extended on the same surface as the other one of the contact portions of the high-voltage electrode and the ground electrode via the through hole.

3. The ion generator according to claim 1, wherein a plurality of the wire electrodes are provided.

4. The ion generator according to claim 3, wherein a wire electrode of the plurality of wire electrodes is disposed at both end portions of the insulating substrate.

5. The ion generator according to claim 4, wherein the ground electrode has a substantially X-shaped pattern.

6. The ion generator according to claim 1, wherein a leading end portion of the ground electrode facing a leading end of the wire electrode is not covered with the insulating film.

7. The ion generator according to claim 6, wherein the ground electrode is a resistor.

8. The ion generator according to claim 1, wherein a cutout is provided at one side of the insulating substrate, the leading end of the wire electrode is arranged in the cutout, and legs of the ground electrode extend substantially parallel to the wire electrode sandwiched between the legs on opposite sides of the cutout on the insulating substrate.

9. The ion generator according to claim 1, further comprising:

a first terminal connected to the contact portion of the high-voltage electrode and including a retaining portion arranged to be connected to a lead wire;

a second terminal connected to the contact portion of the ground electrode and including a retaining portion arranged to be connected to another lead wire; and a case arranged to accommodate the insulating substrate, the ground electrode, the wire electrode, the high-voltage electrode, the first terminal, and the second terminal.

10. The ion generator according to claim 9, wherein ribs are provided at an opening of the case which faces the leading end of the wire electrode.

* * * * *